US011610522B2

(12) United States Patent
Masuda et al.

(10) Patent No.: US 11,610,522 B2
(45) Date of Patent: Mar. 21, 2023

(54) DISPLAY DEVICE, DISPLAY CONTROL METHOD, AND NON-TRANSITORY COMPUTER-READABLE RECORDING MEDIUM

(71) Applicant: SHARP KABUSHIKI KAISHA, Sakai (JP)

(72) Inventors: Yusuke Masuda, Sakai (JP); Kentaroh Kamada, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/690,512

(22) Filed: Mar. 9, 2022

(65) Prior Publication Data

US 2022/0293022 A1 Sep. 15, 2022

(30) Foreign Application Priority Data

Mar. 10, 2021 (JP) ..... JP2021-038666
Feb. 2, 2022 (JP) ..... JP2022-015062

(51) Int. Cl.
*G09G 3/00* (2006.01)
*G09G 3/3233* (2016.01)

(52) U.S. Cl.
CPC ..... *G09G 3/006* (2013.01); *G09G 3/3233* (2013.01); *G09G 2330/045* (2013.01); *G09G 2330/12* (2013.01)

(58) Field of Classification Search
CPC ..... G09G 3/006; G09G 3/3233; G09G 2330/045; G09G 2330/12
See application file for complete search history.

(56) References Cited

U.S. PATENT DOCUMENTS

2008/0018569 A1* 1/2008 Sung ..... G09G 3/3233 345/82
2010/0045709 A1 2/2010 Nakamura et al.

FOREIGN PATENT DOCUMENTS

JP 2010-048939 A 3/2010

* cited by examiner

*Primary Examiner* — Kenneth B Lee, Jr.
(74) *Attorney, Agent, or Firm* — ScienBiziP, P.C.

(57) ABSTRACT

A display device includes a display panel; a temperature information acquisition unit that acquires peripheral temperature information on a periphery of the display panel; and a control unit that controls drive current to be supplied to the display panel. The control unit controls the drive current to be supplied to the display panel to a first drive current value when a peripheral temperature indicated by the peripheral temperature information is within a prescribed temperature range, and a second drive current value lower than the first drive current value when the peripheral temperature indicated by the peripheral temperature information is higher than the prescribed temperature range.

13 Claims, 7 Drawing Sheets

| PERIPHERAL TEMPERATURE | PANEL SURFACE TEMPERATURE | DRIVE CURRENT VALUE |
|---|---|---|
| 30°C | 40°C | WITHOUT CORRECTION ( × 1.0) |
| 35°C | 45°C | WITH CORRECTION ( × 0.9) |
| 40°C | 50°C | WITH CORRECTION ( × 0.8) |

DISPLAY DEVICE, DISPLAY CONTROL METHOD, AND NON-TRANSITORY COMPUTER-READABLE RECORDING MEDIUM

BACKGROUND

1. Field

The present disclosure relates to a display device, a display control method, and a non-transitory computer-readable recording medium.

2. Description of the Related Art

In a display panel of a display device such as a television (TV) receiver, it is desirable to control the value of drive current to be supplied to the display panel so as not to damage an element constituting the display panel due to an excessive increase in temperature of the element caused by, for example, heat generation of the element. For this reason, there has been proposed a technique of adjusting the value of the drive current to be supplied to the display panel so that the temperature of the display panel does not increase above a prescribed value. For example, Japanese Unexamined Patent Application Publication No. 2010-048939 discloses a technique in which a temperature detection circuit provided in a display device calculates, in a temperature signal processing circuit, a temperature of an element from a potential difference between different values of current flowing through the temperature detection circuit, and corrects the value of current to be supplied to the element in accordance with the calculated temperature.

However, in the above-described related art, only heat generation due to self-light emission of the element constituting the display panel is detected. Hence, when the temperature in a housing of the display device increases not depending on self-light emission of the element constituting the display panel or heat generation by a backlight, the value of the drive current to be supplied to the display panel may not be corrected.

It is desirable to provide a display device capable of recognizing heat generation in a housing of a display device, appropriately controlling the value of drive current for driving a display panel, and controlling the surface temperature of the display panel.

SUMMARY

According to an aspect of the present disclosure, there is provided a display device including a display panel; a temperature information acquisition unit that acquires peripheral temperature information on a periphery of the display panel; and a control unit that controls drive current to be supplied to the display panel. The control unit controls the drive current to be supplied to the display panel to a first drive current value when a peripheral temperature indicated by the peripheral temperature information is within a prescribed temperature range, and a second drive current value lower than the first drive current value when the peripheral temperature indicated by the peripheral temperature information is higher than the prescribed temperature range.

According to another aspect of the present disclosure, there is provided a display control method of a display device, the display device including a display panel, a temperature information acquisition unit that acquires peripheral temperature information on a periphery of the display panel, and a control unit that controls drive current to be supplied to the display panel. The display control method includes acquiring the peripheral temperature information by the temperature information acquisition unit; and controlling, by the control unit, the drive current by using a weight coefficient corresponding to the peripheral temperature information acquired by the temperature information acquisition unit.

According to still another aspect of the present disclosure, there is provided a non-transitory computer-readable recording medium storing a display control program for causing a computer to function as the above-described display device, the display control program causing the computer to function as the control unit.

DESCRIPTION OF THE EMBODIMENTS

Hereinafter, an embodiment according to an aspect of the present disclosure (hereinafter also referred to as "present embodiment") will be described with reference to the drawings.

Configuration of Display Device

Figure 1:
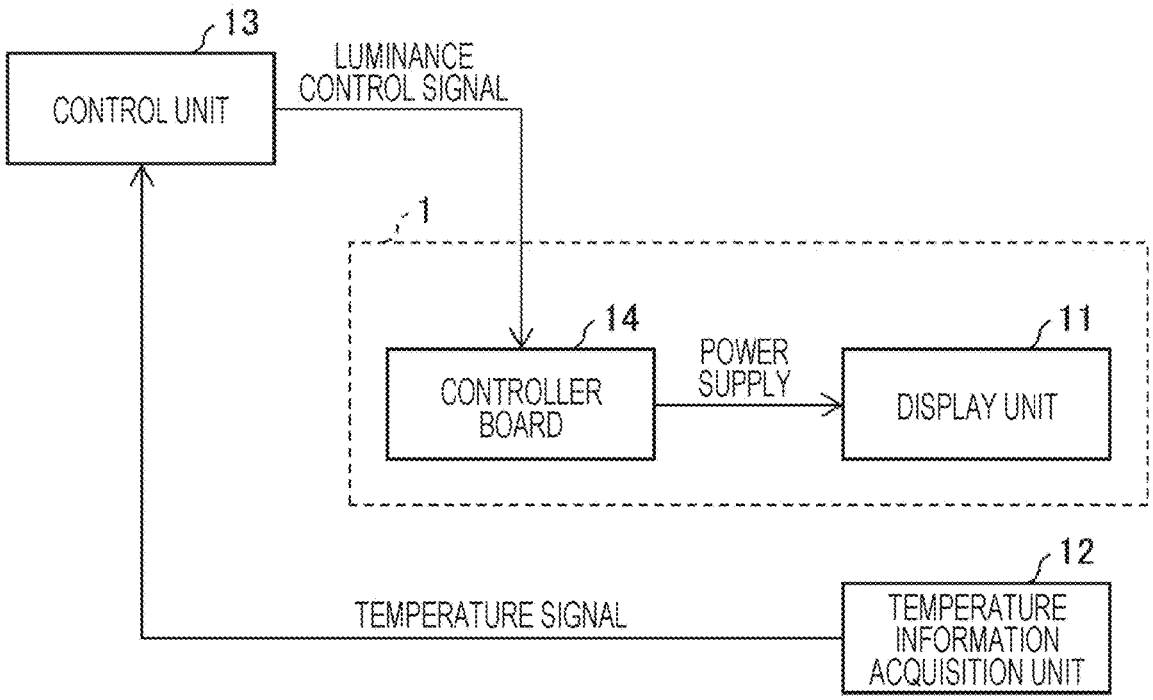
FIG. 1 is a block diagram illustrating a configuration of a display device according to an embodiment of the present disclosure.
Figure 8:
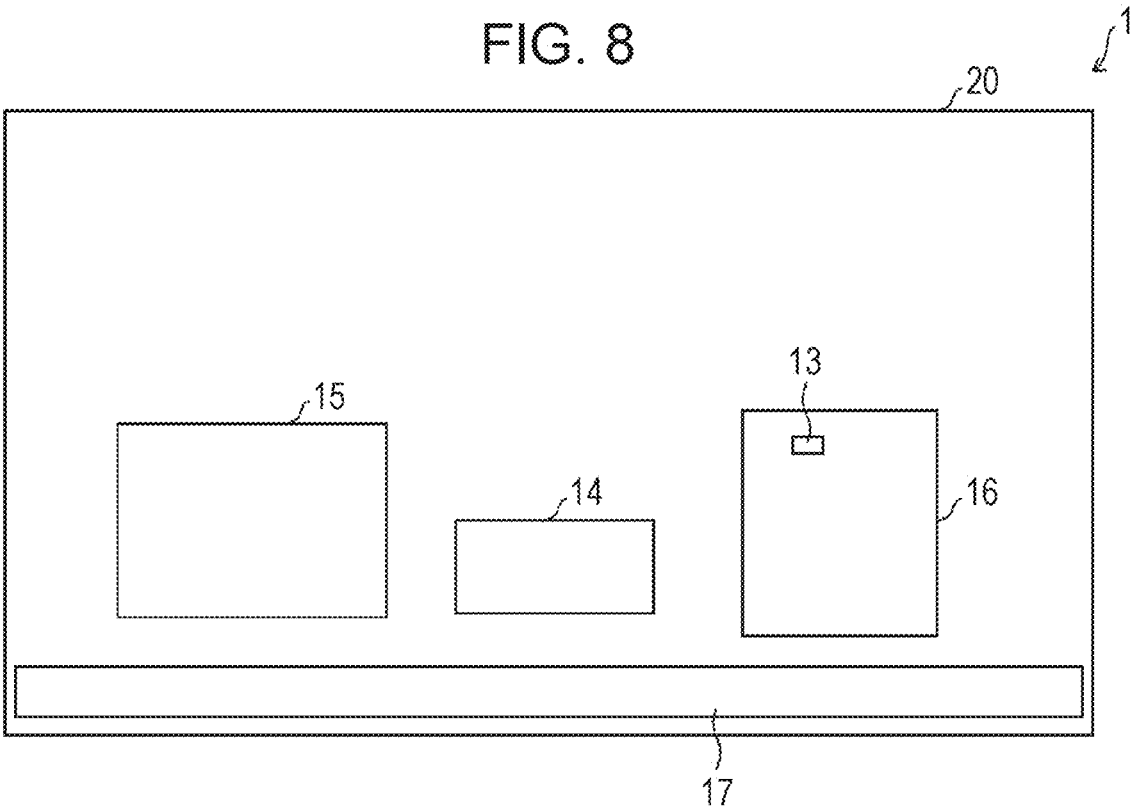
FIG. 8 is a rear view illustrating an example of an installation position of a temperature sensor at a display panel of a display device according to a first embodiment of the present disclosure (first configuration example)
Figure 9:
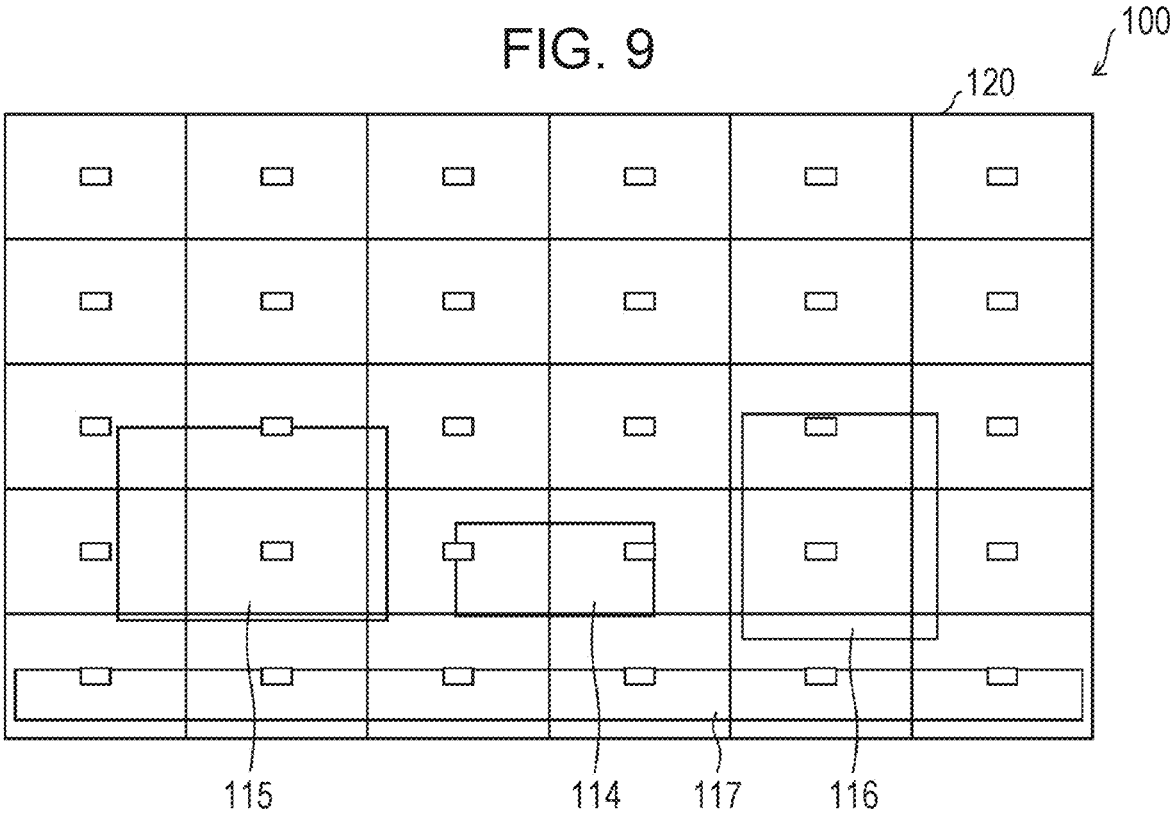
FIG. 9 is a rear view illustrating an example of an installation position of a temperature sensor at a display panel of a display device according to a second embodiment of the present disclosure (second configuration example)
Figure 11:
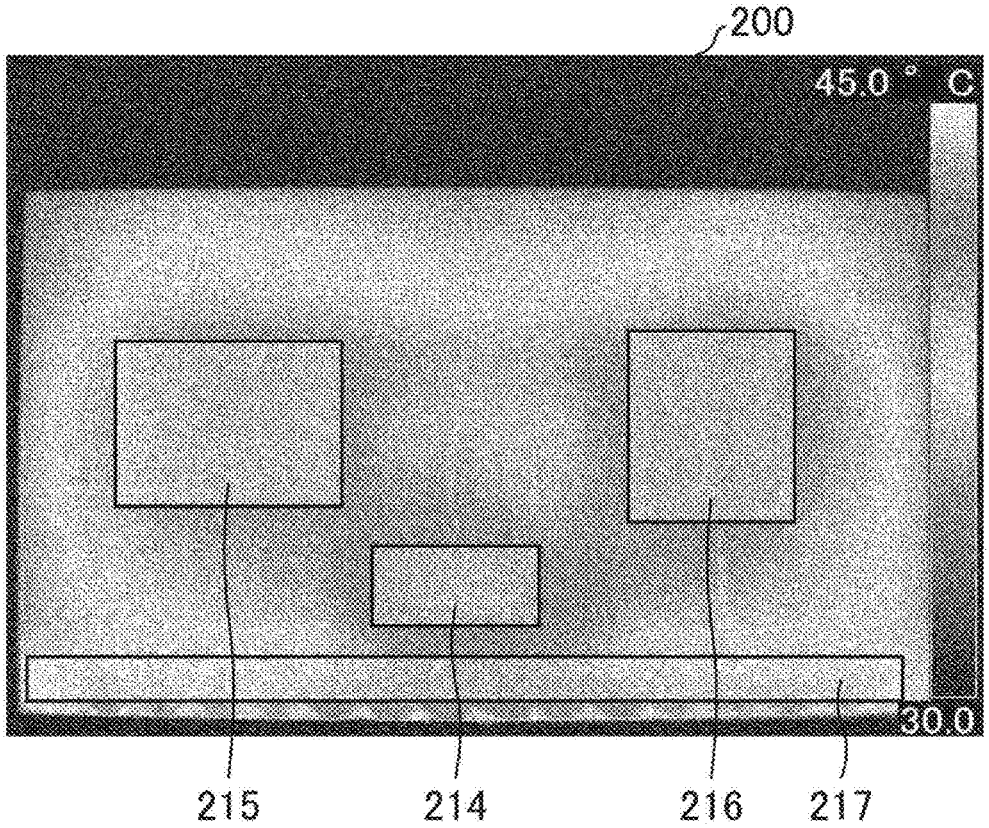
FIG. 11 is a thermographic image presenting a heat generation state of a display panel of a display device according to a third embodiment of the present disclosure (third configuration example)

First, a configuration of a display device 1 according to the present embodiment will be described with reference to FIG. 1. The display device 1 of the present embodiment is, for example, a TV receiver. As illustrated in FIG. 1, the display device 1 includes a display unit (display panel) 11, a temperature information acquisition unit 12, a control unit 13, and a controller board (timing controller (TCON) board) 14. As illustrated in FIGS. 8, 9, and 11, the display device 1 further includes a power supply board 15 (115, 215), a main board 16 (116, 216), a source driver 17 (117, 217), and so forth. The control unit 13 is mounted on the main board 16 (116, 216).

The display panel 11 includes a plurality of pixels arranged in a matrix. Each pixel may include a self-light-emission element such as an organic EL element or may be an element of a type irradiated with light of a backlight, for example, a liquid crystal element.

The temperature information acquisition unit 12 includes, for example, a thermistor (temperature sensor). As an example, the temperature sensor may be disposed in a housing of the display device 1. As another example, the temperature sensor may be disposed outside the housing of the display device 1. The temperature sensor included in the temperature information acquisition unit 12 acquires temperature information on the periphery of the display panel 11. The specific arrangement position of the temperature sensor will be described later (first to fourth configuration examples). The temperature information acquired by the temperature information acquisition unit 12 is transmitted to the control unit 13. The "periphery of the display panel 11" in the present embodiment includes the inside of the display panel, the outside of the display panel, and a surface of the display panel. The "temperature information" in the present embodiment may include not only the temperature itself but also information for representing the temperature or information for calculating the temperature.

The control unit 13 performs signal processing on video displayed on the display panel 11. The control unit 13 controls drive current to be supplied to the display panel 11 in accordance with the peripheral temperature acquired by the temperature information acquisition unit 12. For example, the control unit 13 may control the drive current to be supplied to the display panel 11 by using a weight coefficient that corresponds to the peripheral temperature acquired by the temperature information acquisition unit 12 and that is smaller than 1. For example, a value of drive current before correction may be multiplied by a weight coefficient to calculate a corrected value, and the drive current having the calculated corrected value may be supplied to the display panel 11. For example, as the peripheral temperature acquired by the temperature information acquisition unit 12 is higher, the value of drive current serving as a reference may be corrected by using a smaller weight coefficient. For example, a current value, for example, a first drive current value that is appropriate when the peripheral temperature is within a room temperature range (for example, from 25° C. to 30° C., hereinafter also referred to as a "prescribed temperature range") may be set first. The weight coefficient may be decremented by 0.05, such as 0.95, 0.90, 0.85, . . . , as the peripheral temperature increases by 1° C. with reference to the set current value.

When the peripheral temperature is a prescribed temperature or higher, the control unit 13 may calculate the corrected value and supply the drive current having the calculated corrected value to the display panel 11. As an example, when the temperature indicated by the peripheral temperature information is higher than the prescribed temperature range, the control unit 13 may perform control so that the current value becomes a second drive current value lower than the first drive current value. The prescribed temperature may be, for example, 45° C. that is the upper limit temperature at which an element normally operates. That is, the peripheral temperature may be about 35° C. Until the peripheral temperature exceeds 35° C., the above-described current value serving as the reference may be used, and when the peripheral temperature is 35° C. or higher, the corrected current value, that is, the above-described second drive current value may be used. The control unit 13 may further control the drive current by using a weight coefficient corresponding to an average picture level value of the display panel 11. A scheme for calculating the drive current to be supplied to the display panel 11 by using the weight coefficient corresponding to the average picture level value will be described later.

The value of the drive current calculated by the control unit 13 is transmitted to the controller board 14. The controller board 14 synchronizes the operation timings of respective components in the display device 1 and turns on and off a light emitting element constituting the display panel 11. The controller board 14 (114, 214, 314) (described later) obtains current to be used from the power supply board 15 (115, 215, 315) (described later) in accordance with the drive current value calculated by the control unit 13, and supplies the current to the source driver 17 (117, 217, 317) (described later). The source driver 17 (117, 217, 317) supplies drive current to be used to the display panel 11 and drives the display panel 11.

In the display device 1, the luminance of the display panel 11 is controlled based on the drive current to be supplied to the display panel 11. That is, the luminance of the display panel 11 increases in proportion to the value of the drive current to be supplied to the display panel 11. Thus, by controlling the drive current to be supplied to the display panel, it is possible to control the luminance of the display panel and the surface temperature of the display panel.

Figure 2:
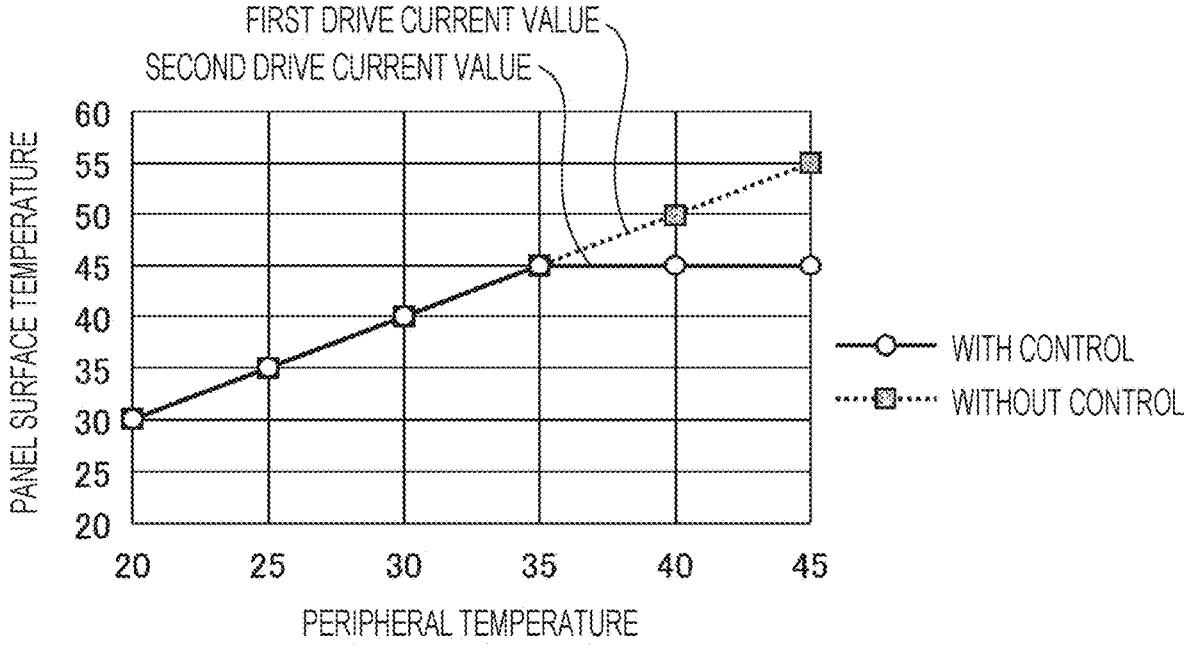
FIG. 2 is a graph schematically presenting the relationship between the peripheral temperature and the surface temperature of a display panel in the display device according to the embodiment of the present disclosure.

Relationship between Peripheral Temperature and Surface Temperature of Display Panel Next, the relationship between the peripheral temperature and the surface temperature of the display panel 11 will be described with reference to FIG. 2. FIG. 2 is a graph schematically presenting the relationship between the peripheral temperature and the surface temperature of the display panel 11 in the display device 1 according to the embodiment of the present disclosure. In the graph, the horizontal axis represents the peripheral temperature of the display device 1 and the vertical axis represents the surface temperature of the display panel 11.

As long as the relationship between the temperature acquired by the temperature sensor of the temperature information acquisition unit 12 and the peripheral temperature is acquired by measurement in advance, the peripheral temperature can be estimated from the value of the temperature acquired by the temperature sensor. Then, by using a graph as illustrated in FIG. 2, the surface temperature of the display panel 11 can be estimated from the peripheral temperature.

In FIG. 2, a case of controlling the surface temperature of the display panel 11 is indicated by a solid line, and a case of not controlling the surface temperature of the display panel 11 is indicated by a broken line. In FIG. 2, the solid line indicates the control on the surface temperature of the display panel 11 using the second drive current value, and the broken line indicates the control on the surface temperature of the display panel 11 using the first drive current value.

As illustrated in FIG. 2, the peripheral temperature is substantially proportional to the surface temperature of the display panel 11. For example, the surface temperature of the display panel 11 is 35° C. when the peripheral temperature is 25° C., and the surface temperature of the display panel 11 is 45° C. when the peripheral temperature is 35° C. In the present embodiment, the upper limit temperature at which the operation of the organic EL element used in the display panel 11 is guaranteed is, for example, 45° C.

In the case of not controlling the surface temperature of the display panel 11 (broken line), even when the peripheral temperature exceeds 35° C., the surface temperature of the display panel 11 increases and exceeds 45° C. that is the upper limit temperature. In contrast, in the case of controlling the surface temperature of the display panel 11 (solid line), when the peripheral temperature exceeds 35° C., the luminance of the display panel (accordingly, the current value) is suppressed to control the surface temperature of the display panel 11 so as not to exceed 45° C. In order to suppress the luminance of the display panel 11, the drive current to be supplied to the display panel 11 is decreased. As a scheme for suppressing the luminance of the display panel 11 (accordingly, the drive current value), a scheme for decreasing the luminance (accordingly, the drive current value) when the temperature reaches a set upper limit temperature (for example, 45° C.) or higher may be employed.

Figure 3:
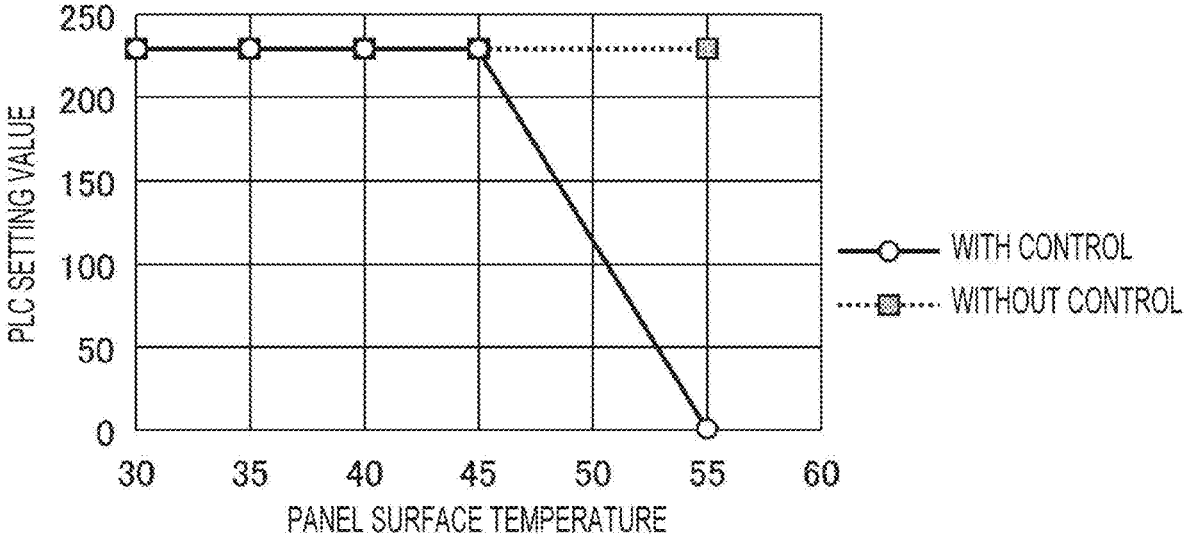
FIG. 3 is a graph presenting the relationship between the surface temperature of the display panel and the programmable logic control (PLC) setting value in the display device according to the embodiment of the present disclosure.

A scheme for controlling the luminance of the display panel 11, that is, the value of the drive current to be supplied to the display panel 11 will be described later. Relationship between Surface Temperature of Display Panel and PLC Setting Value Next, a scheme for controlling a PLC setting value in the display panel 11 will be described with reference to FIG. 3. FIG. 3 is a graph schematically presenting an example of the relationship between the surface temperature of the display panel 11 and the programmable logic control (PLC) setting value in the display device 1 according to the embodiment of the present disclosure. The horizontal axis represents the surface temperature of the display panel 11, and the vertical axis represents the PLC setting value. Further, in FIG. 3, a case of controlling the PLC setting value of the display panel 11 is indicated by a solid line, and a case of not controlling the PLC setting value of the display panel 11 is indicated by a broken line.

In this case, the PLC setting value is an example of a setting value for controlling the value of the drive current to be supplied to the display panel 11, and the term "PLC" does not limit the present embodiment.

In the case of not controlling the PLC setting value (broken line), the PLC setting value is normally constant. Accordingly, the surface temperature of the display panel 11 exceeds 45° C. In contrast, in the present embodiment, as indicated by the solid line, setting is provided such that the PLC setting value is controlled when the surface temperature of the display panel 11 reaches 45° C. that is the upper limit temperature or higher. For example, setting is provided such that the PLC setting value is linearly decreased when the surface temperature of the display panel 11 reaches 45° C. that is the upper limit temperature or higher, and the PLC setting value becomes 0 when the surface temperature of the display panel 11 reaches 55° C. In the example illustrated in FIG. 3, when the surface temperature of the display panel 11 is 55° C. and the PLC setting value is 0, the luminance of the display panel 11 is 0, that is, the display panel 11 is in an unlit state. At this time, the surface temperature of the display panel 11 coincides with the peripheral temperature.

Relationship Between Average Picture Level Value and Luminance in Display Panel

Figure 4:
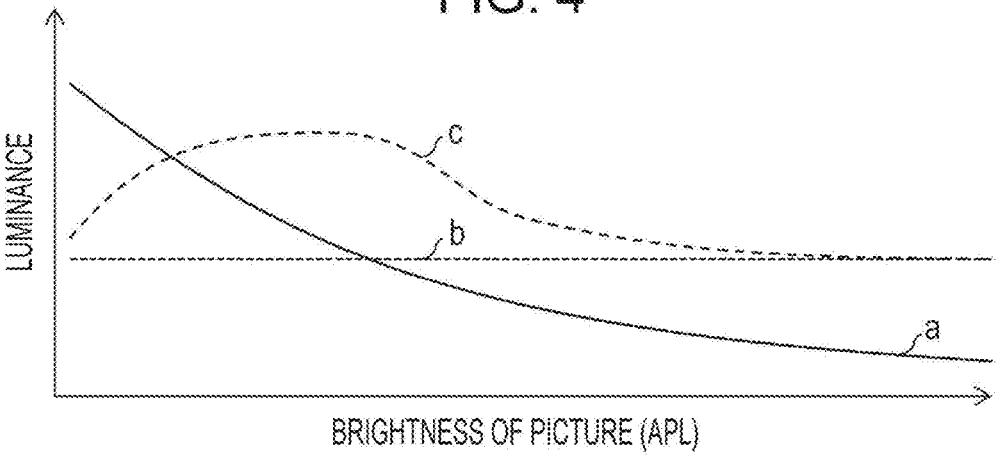
FIG. 4 is a graph presenting the relationship between the average picture level (APL) and the luminance in each of a case where the display panel includes an organic electroluminescence (EL) element, a case where the display panel includes a liquid crystal element (with area driving), and a case where the display panel includes a liquid crystal element (without area driving)

Next, with reference to FIG. 4, the relationship between the average picture level (hereinafter, also referred to as an "APL value") of the display panel 11 and the luminance will be described. FIG. 4 is a graph presenting the relationship between the APL value of the display panel 11 in the display device 1 and the luminance of lit pixels. The horizontal axis indicates the APL value of the display panel 11 and the vertical axis indicates the luminance. In the graph of FIG. 4, (a) indicates a case where the display panel 11 includes an organic EL element, (b) indicates a case where the display panel 11 includes a liquid crystal element and does not perform area driving, and (c) indicates a case where the display panel 11 includes a liquid crystal element and performs area driving.

Figure 5:
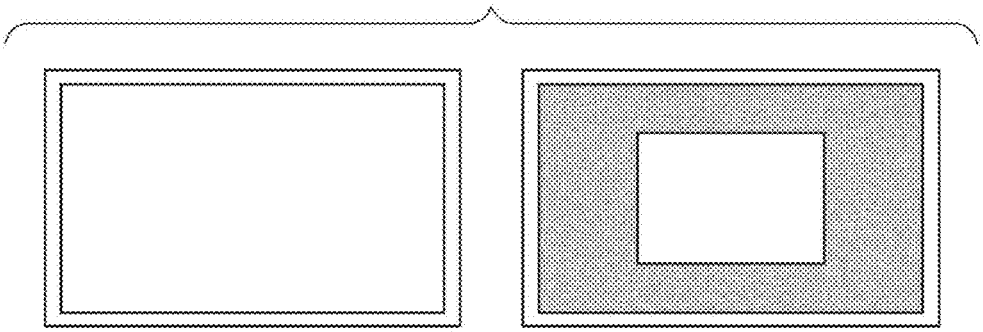
FIG. 5 illustrates video images having different APL values in the display device according to the embodiment of the present disclosure.

FIG. 5 illustrates the relationship between the area of the window and the luminance of the display panel 11. When the display panel 11 indicates the same gray scale, the luminance in the vicinity of the center of the pixels is higher in a case where only the 25% region of the window is lit as indicated on the right side of FIG. 5 than in a case where the 100% region of the window is lit as indicated on the left side of FIG. 5. That is, when the element constituting the display panel 11 is an organic EL element, the luminance can be increased as the APL value is smaller. Thus, as indicated by (a) of FIG. 4, the luminance plots a smoothly decreasing curve as the APL value increases.

In contrast, in the case of the liquid crystal window without area driving, as indicated by (b) of FIG. 4, the luminance is constant as long as the gray scale of the display panel 11 is the same regardless of the magnitude of the APL value. In the case of the liquid crystal window with area driving, since it is not possible to perform control on the one-pixel basis unlike the organic EL element, a curve as indicated by (c) of FIG. 4 is obtained although the curve varies depending on the number of divided areas of the backlight of the display panel 11.

Control on Drive Current Value (Luminance) Based on APL Value

In the display device 1, luminance values for a plurality of (for example, seven) APL values at room temperature (for example, from 25° C. to 30° C.) may be set in advance, and the luminance value corresponding to the APL value according to the peripheral temperature acquired by the temperature information acquisition unit 12 may be multiplied by a weight coefficient smaller than 1 to correct the luminance value (accordingly, the value of the drive current to be supplied to the display panel). Hereinafter, a method of controlling the drive current to be supplied to the display panel 11 (that is, luminance) based on the APL value in the display panel 11 including the organic EL element will be described with reference to FIGS. 6 and 7. In a display device using a liquid crystal panel, the same control method as that of the display panel including the organic EL element can be implemented by controlling the luminance of the backlight.

Figure 6:
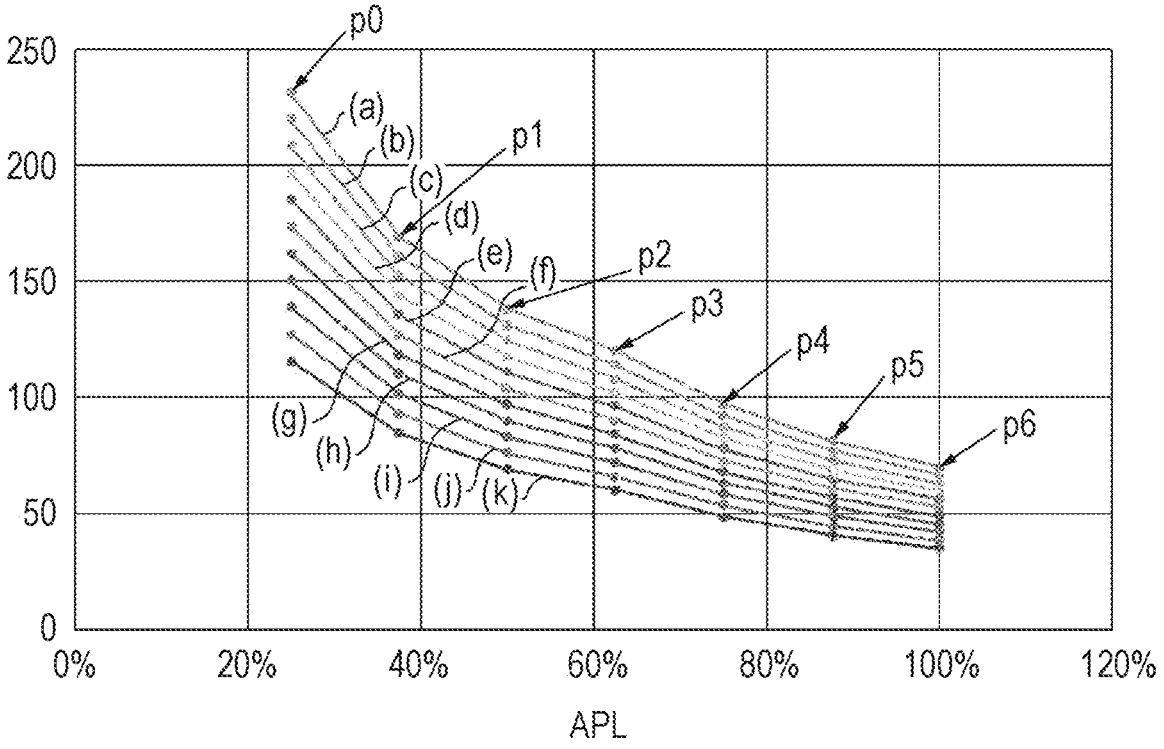
FIG. 6 is a graph presenting an example of the relationship between the APL value and the luminance in the display device according to the embodiment of the present disclosure.

FIG. 6 is a graph presenting an example of the relationship between the APL value and the luminance in the display panel 11 of the display device 1 according to the present embodiment. The horizontal axis of the graph of FIG. 6 represents the APL value, and the vertical axis represents the average luminance of the display panel. (a) of FIG. 6 indicates the relationship between the APL value and the luminance when the peripheral temperature is room temperature (for example, from 25° C. to 30° C.). That is, average luminance values corresponding to seven points of p0, p1, p2, p3, p4, p5 and p6 among the APL values of the horizontal axis are set. In the horizontal axis of the graph of FIG. 6, the APL value increases as moving to the right side from p0, to p1, p2, p3, p4, p5, and p6. That is, the lit region in the display panel 11 is expanded. Accordingly, the corresponding luminance is set to gradually decrease. The luminance values corresponding to the APL values among these seven points are obtained by linear interpolation. The initially set luminance values with regard to the APL values may be set at seven points as described above, but may be at points more or less than seven points.

In the graph of FIG. 6, curves (b), (c), (d), (e), (f), (g), (h), (i), and (j) each indicate the relationship between the APL value and the luminance at a constant peripheral temperature. As the curve transitions from (a), to (b), (c), (d), (e), (f), (g), (h), (i), and (j), the peripheral temperature increases. Thus, every time the peripheral temperature increases, the luminance value in the curve (a) is multiplied by a constant weight coefficient to correct the value of the drive current. At this time, since it is desirable to greatly suppress the value of the drive current as the peripheral temperature increases, the value of the weight coefficient to be multiplied when correcting the value of the drive current may be gradually decreased, for example, to 0.95, 0.9, 0.85, . . . , as the peripheral temperature increases.

Figure 7:
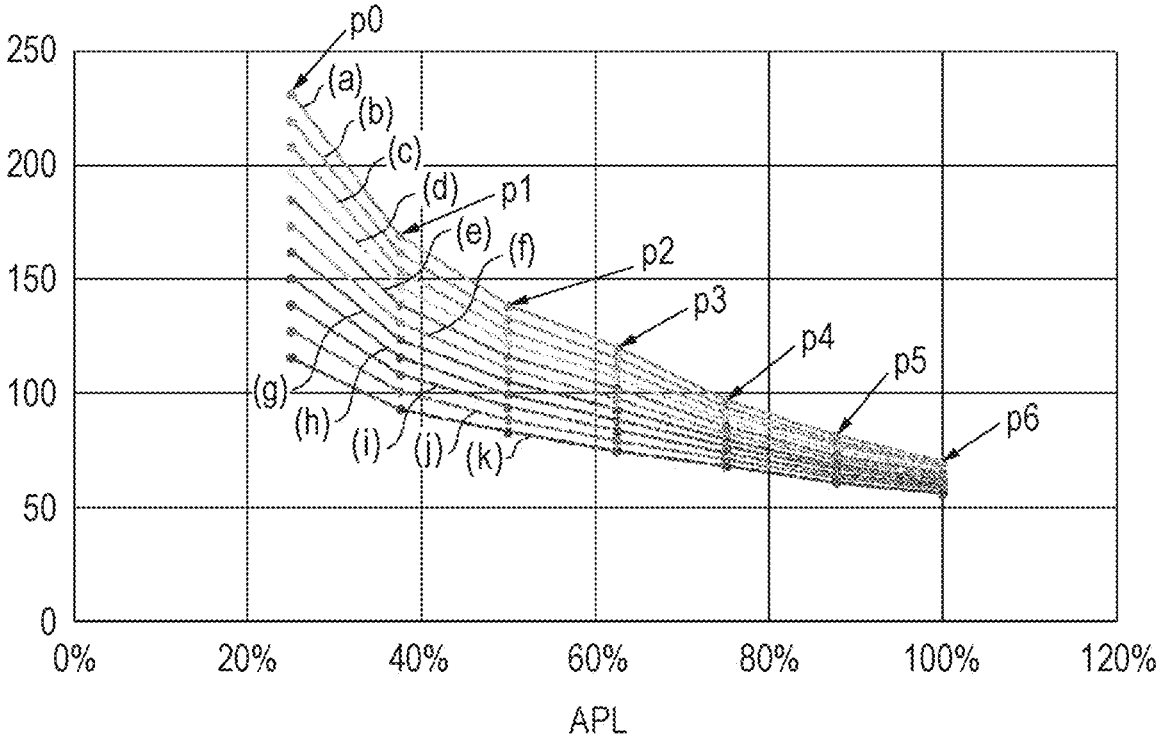
FIG. 7 is a graph presenting another example of the relationship between the APL value and the luminance in the display device according to the embodiment of the present disclosure.

As described above, the control unit 13 may control the luminance value of the display panel 11 with respect to the APL value (accordingly, the value of the drive current to be supplied to the display panel) by uniformly multiplying the APL value by the weight coefficient in accordance with the peripheral temperature. Alternatively, the control unit 13 may further control the drive current by using a weight coefficient corresponding to the average picture level value of the display panel 11. For example, a weight coefficient closer to 1 may be used as the average picture level value is larger. FIG. 7 illustrates the relationship with the luminance when the weight coefficient is changed in accordance with the APL value even at the same peripheral temperature. As in FIG. 6, as the curve transitions from (a), to (b), (c), (d), (e), (f), (g), (h), (i), and (j), the peripheral temperature increases. As compared with the curves of FIG. 6, it is found that the curves in FIG. 7 are gentle as a whole.

When the APL value is large, the load on the element is relatively small although the luminance is increased. Thus, as compared to the case where the APL value is small, the element is not damaged although the control on the luminance (accordingly, the value of the drive current) is made gentle. Thus, as long as the drive current to be supplied to the display panel 11 is controlled by using the weight coefficient corresponding to the average picture level value in addition to the surface temperature of the display panel 11, it is possible to protect the element constituting the display panel 11 while securing the luminance of the display screen.

As the installation position of the temperature sensor of the temperature information acquisition unit 12, the following first to fourth configuration examples are conceivable. Hereinafter, these configuration examples will be described.

First Configuration Example (First Embodiment)

A first configuration example of the present disclosure will be described below. In the first configuration example, the display device 1 may further include a main board 16 that performs signal processing on video, and the temperature information acquisition unit 12 may be installed at a position corresponding to the main board 16.

FIG. 8 is a configuration diagram of the display panel 11 of the display device 1 according to the first configuration example of the present disclosure viewed from a rear surface. As illustrated in FIG. 8, a rear surface of the display panel 11 of the display device 1 is covered with a metal back cover 20. A power supply board 15, a controller board 14, the main board 16, and a source driver 17 are provided inside the metal back cover 20. In the present configuration example, a thermistor (temperature sensor) is provided on a back surface of the metal back cover 20 or inside the metal back cover 20, at a position corresponding to the main board 16.

The main board 16 processes a picture displayed on the display panel 11. The control unit 13 that controls drive current to be supplied to the display panel 11 is installed on the main board 16. Thus, by installing the temperature sensor on the main board 16, information on the peripheral temperature detected by the temperature sensor can be efficiently transmitted to the control unit 13 installed on the main board 16. In this case, excessive heat generation can be suppressed by estimating the surface temperature of the display panel 11 from the correlation between the surface temperature of the display panel 11 and the temperature detected by the temperature sensor installed on the main board 16, and controlling the drive current to be supplied to the display panel 11 in accordance with the result.

As described above, the detected peripheral temperature is sent to the control unit 13 mounted on the main board 16. The drive current value determined by the control unit 13 is transmitted to the controller board 14. The controller board 14 acquires current to be used from the power supply board 15 and sends a signal and the current to be used to the source driver 17. The source driver 17 drives an element of the display panel 11.

Second Configuration Example (Second Embodiment)

A second configuration example of the present disclosure will be described below. In the second configuration example, the temperature information acquisition unit 12 may include at least one temperature sensor, and the at least one temperature sensor may be installed at a portion corresponding to the display panel 11. FIG. 9 is a rear view illustrating an example of an installation position of a temperature sensor at the display panel 11 of a display device 100 according to the second configuration example. As illustrated in FIG. 9, a display panel 122 is divided into a plurality of areas arranged in a matrix and having substantially equal areas, and a temperature sensor is provided for each of the divided areas.

Figure 10:
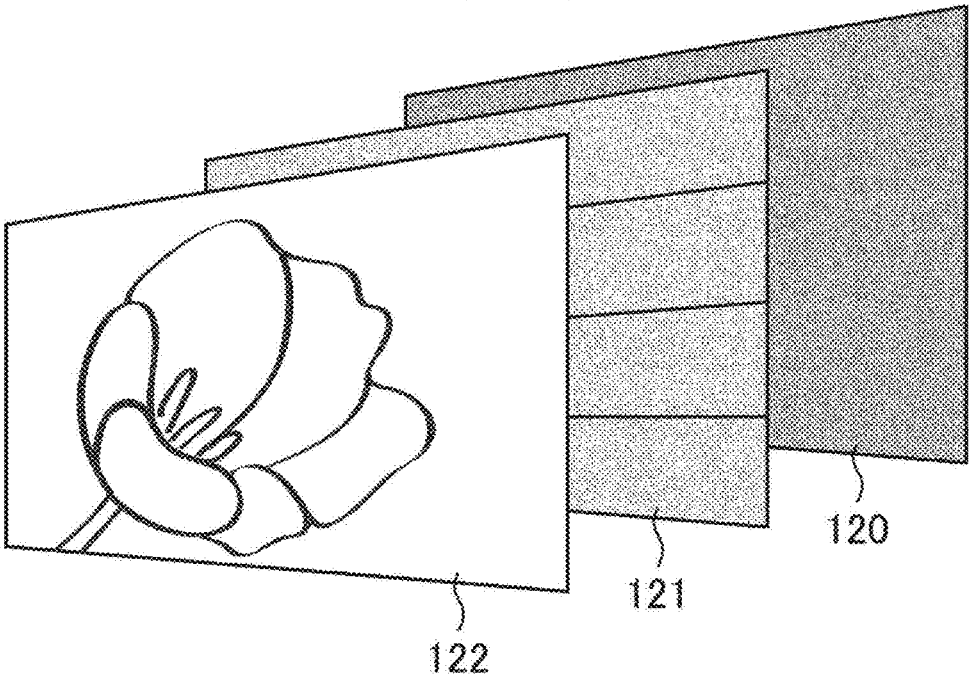
FIG. 10 illustrates a configuration including the display panel of the display device according to the second embodiment of the present disclosure (second configuration example)

FIG. 10 is a configuration diagram of a display panel of the display device 100 according to the second configuration example of the present disclosure. As illustrated in FIG. 10, in the display device including an organic EL element, a back surface of the display panel 122 is covered with a metal back cover 120, and an inner plate 121 for heat dissipation is provided between the display panel 122 and the metal back cover 120.

The temperature sensor may be installed between the inner plate 121 and the metal back cover 120 or on a back surface of the metal back cover 120. Setting may be provided such that the main board 116 acquires peripheral temperatures detected by a plurality of temperature sensors, and when at least one of the peripheral temperatures reaches a prescribed temperature (for example, 45° C. of the upper limit temperature) or higher, the main board 116 controls the drive current to be supplied to the display panel 122 by using a weight coefficient corresponding to the detected peripheral temperature.

With the second configuration example, the surface temperature of the display panel 122 can be detected in a wide range. In addition, the peripheral temperature can be detected in a place relatively close to the display panel 122. Thus, the value of the drive current to be supplied to the display panel 122 can be corrected more accurately.

When a plurality of temperature sensors are disposed in a region defined by a target picture displayed on the display panel 11, the drive current in the region may be controlled by using a weight coefficient corresponding to the highest peripheral temperature among peripheral temperatures indicated by the plurality of temperature sensors. For example, when video content is displayed in one continuous display range on the display panel 11 and character content is displayed in another display range, and when a plurality of temperature sensors are disposed at positions corresponding to the continuous region where the video content is displayed, the drive current to be supplied to the entire region is controlled by using a weight coefficient corresponding to the highest peripheral temperature among the peripheral temperatures detected by the respective temperature sensors. Thus, the value of the current can be controlled by using the weight coefficient suitable for the surface temperature of the region in the continuous region, and a viewer can enjoy a natural picture without unevenness in luminance in the content in the continuous region.

The control unit 13 can identify in which region of the display unit the content is displayed by referring to a video signal presenting content for display, metadata of the content, setting information on the display device, or the like. The above-described control can be suitably performed by referring to the result of the identification.

Third Configuration Example (Third Embodiment)

A third configuration example of the present disclosure will be described below. In the third configuration example, the display device 1 may include a power supply board 215, a source driver 217, and a controller board 214. The temperature information acquisition unit 12 may include one temperature sensor or a plurality of temperature sensors, and the one temperature sensor or the plurality of temperature sensors may be installed at positions corresponding to at least one of the power supply board 215, the source driver 217, and the controller board 214.

FIG. 11 is a thermographic image presenting a heat generation state of a display panel 11 of a display device 200 according to the third configuration example. As illustrated in FIG. 11, it is found that heat is generated at positions corresponding to components such as the power supply board 215, a main board 216, the controller board 214, and the source driver 217 of the display device 200, and the temperature is high. It is found that the amount of heat generation is particularly large at positions corresponding to the source driver 217 and the controller board 214.

Hence, by installing temperature sensors at positions corresponding to the components having particularly large amounts of heat generation such as the source driver 217 and the controller board 214, the position where the element generates the most heat or the maximum surface temperature of the display panel 11 can be detected. Thus, the value of the drive current to be supplied to the display panel 11 can be appropriately corrected, and damage to the element constituting the display panel 11 can be avoided.

Fourth Configuration Example (Fourth Embodiment)

A fourth configuration example of the present disclosure will be described below. In the fourth configuration example, the temperature information acquisition unit 12, specifically, a temperature sensor is disposed outside a display device 300.

Figures 12, 13:
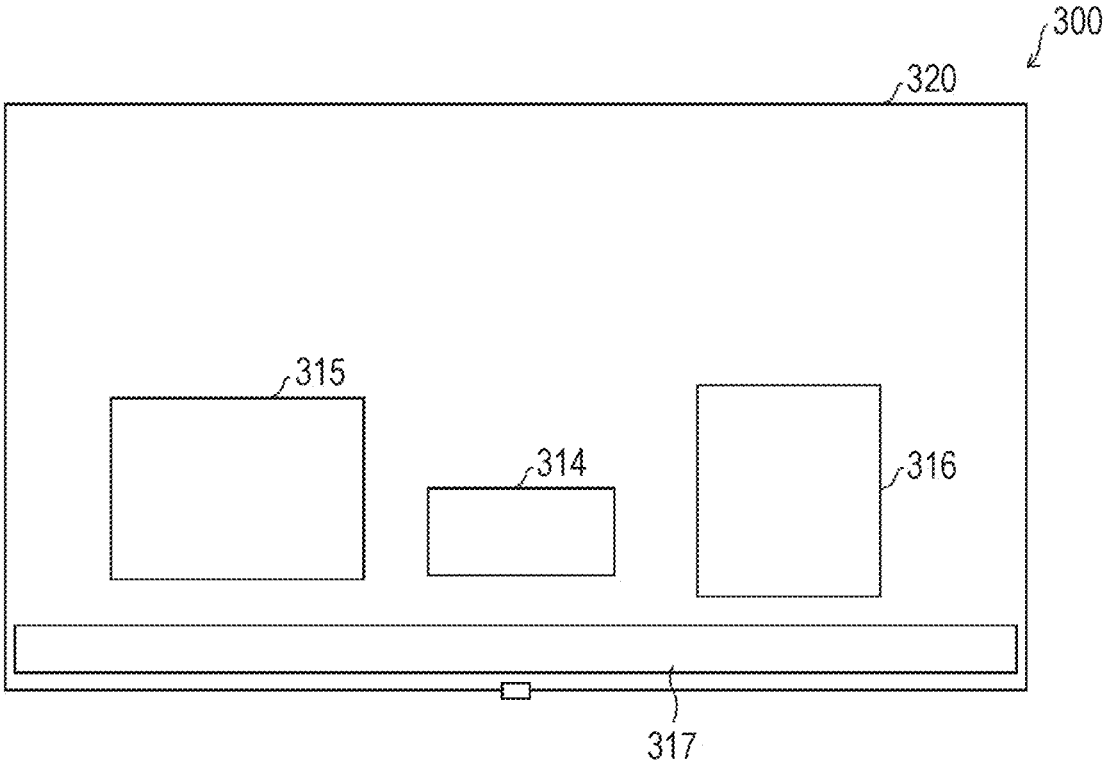
FIG. 12 is a rear view illustrating an example of an installation position of a temperature sensor at a display panel of a display device according to a fourth embodiment of the present disclosure (fourth configuration example)
FIG. 13 is a table based on a peripheral temperature and used in a control unit of the display device illustrated in FIG. 12.

FIG. 12 is a rear view illustrating an example of an installation position of a temperature sensor at a display panel of the display device 300 according to the fourth configuration example of the present disclosure. As illustrated in FIG. 12, a rear surface of the display panel of the display device 300 is covered with a metal back cover 320. The temperature information acquisition unit 12 is desirably disposed at a position close to the center of the display panel in the longitudinal direction. Similarly, when one temperature sensor is disposed inside the display panel, the position close to the center in the longitudinal direction is desirable.

When the arrangement place of the temperature sensor is inside the display device, the control unit 13 uses an output (internal temperature value) of the internal sensor. In this case, the internal temperature of the display device 300 is higher than at least the external temperature. In contrast, when the arrangement place of the temperature sensor is outside the display device (desirably at a center portion of the display panel), the control unit 13 uses an output (external temperature value) of the external sensor. For example, in a case where the internal temperature of the display device 300 is higher than the external temperature by 7° C., a corrected second current value may be used when the internal temperature is 42° C. or higher. Here, the relationship between the external temperature and the internal temperature can be obtained in advance by measurement and stored in a storage unit of the display device 300 in the form of a table, for example.

In FIG. 12, reference numeral 314 denotes a controller board, reference numeral 315 denotes a power supply board, reference numeral 316 denotes a main board, and reference numeral 317 denotes a source driver.

In the present configuration example, by acquiring the peripheral temperature of the display device 300 (display panel) by a temperature sensor disposed outside the display device 300, the display device 300 calculates the temperature inside the housing and stores a table (see FIG. 13) in which the calculated temperature is associated with the current value of the drive current. The table will be described below.

FIG. 13 is a table based on the peripheral temperature used in the control unit of the display device 300 illustrated in FIG. 12. As illustrated in FIG. 13, when the temperature of the place where the display device 300 is installed is 30° C., the surface temperature of the display panel is 40° C. In this case, the control unit 13 does not correct the current value of the drive current. In other words, in this case, the control unit 13 uses a weight coefficient of 1.0.

In contrast, when the temperature of the place where the display device 300 is installed reaches 35° C., the surface temperature of the display panel becomes 45° C. In this case, the control unit 13 corrects the current value of the drive current. Specifically, in this case, the control unit 13 uses a weight coefficient of 0.9.

Further, when the temperature of the place where the display device 300 is installed reaches 40° C., the surface temperature of the display panel becomes 50° C. Also in this case, the control unit 13 corrects the current value of the drive current. Specifically, in this case, the control unit 13 uses a weight coefficient of 0.8.

As described above, in the present configuration example, the control unit 13 of the display device 300 controls the current value of the drive current based on the table illustrated in FIG. 13. In this case, as described above, when the peripheral temperature is different, the control unit 13 uses a different weight coefficient. Further, as described above, as the peripheral temperature is higher, the control unit 13 uses a weight coefficient of a smaller value.

As another configuration example, the temperature information acquisition unit 12 may acquire peripheral temperature information from the Internet or the like without using a temperature sensor, and may set the weight coefficient as described above with reference to the acquired temperature information.

Further, the control unit 13 may correct the current value of the drive current in accordance with the position of the external sensor. For example, when the external sensor is installed at a position close to the center in the longitudinal direction of the display panel, the control unit 13 uses a weight coefficient having a relatively large value. In contrast, when the external sensor is installed at a position close to an end portion of the display panel, the control unit 13 uses a weight coefficient having a relatively small value. When the external sensor is installed at a position close to an end portion of the display panel, the temperature of the display panel is higher than the detection value of the external sensor due to the influence of the peripheral temperature as compared with the case where the external sensor is installed at a position close to the center in the longitudinal direction of the display panel. Hence, the control unit 13 desirably uses a weight coefficient of a relatively small value as described above.

Display Control Method

Figure 14:
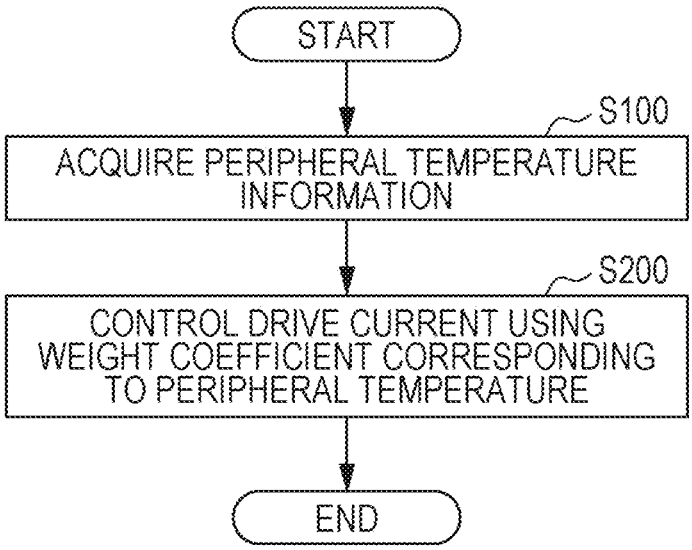
FIG. 14 is a flowchart presenting a flow of processing of a display control method according to an embodiment of the present disclosure.

FIG. 14 is a flowchart presenting a flow of processing in a display control method according to an embodiment of the present disclosure. A process of controlling the drive current to be supplied to the display panel 11 (122) in the display device 1 (100, 200, 300) according to the embodiment of the present disclosure will be described below.

In step S100, the temperature information acquisition unit 12 acquires peripheral temperature information. The acquired peripheral temperature is transmitted to the control unit 13.

Then, in step S200, the control unit 13 controls the drive current to be supplied to the display panel 11 by using the weight coefficient corresponding to the peripheral temperature acquired by the temperature information acquisition unit 12.

According to the above-described display control method, the drive current to be supplied to the display panel 11 is controlled by using the weight coefficient corresponding to the peripheral temperature acquired by the temperature information acquisition unit 12 disposed in the display device, and thus damage to the element due to heat generation can be avoided.

Overview

First Aspect

According to a first aspect of the present disclosure, there is provided a display device including a display panel; a temperature information acquisition unit that acquires peripheral temperature information on a periphery of the display panel; and a control unit that controls drive current to be supplied to the display panel. The control unit controls the drive current to be supplied to the display panel to a first drive current value when a peripheral temperature indicated by the peripheral temperature information is within a prescribed temperature range, and a second drive current value lower than the first drive current value when the peripheral temperature indicated by the peripheral temperature information is higher than the prescribed temperature range.

With the above-described configuration, the value of the drive current to be supplied to the display panel can be appropriately corrected even when the temperature in the housing of the display device increases not depending on heat generation due to self-light emission of the element constituting the display panel. Accordingly, damage to the element can be suppressed.

Second Aspect

In a display device according to a second aspect of the present disclosure, the temperature information acquisition unit may include a temperature sensor disposed inside or outside the display panel.

With the above-described configuration, the temperature information on the inside and outside of the display panel can be acquired.

Third Aspect

In a display device according to a third aspect of the present disclosure, the control unit may control the drive current by using a weight coefficient that corresponds to the peripheral temperature information acquired by the temperature information acquisition unit and that is smaller than 1.

With the above-described configuration, an effect similar to that of the first aspect can be obtained.

Fourth Aspect

In a display device according to a fourth aspect of the present disclosure, the display panel may include an organic EL element.

With the above-described configuration, even when the temperature increases due to heat generation from components other than the organic EL element in the housing of the display device not depending on self-light emission of the organic EL element, the temperature of the display panel can be appropriately maintained and the element can be protected from damage.

Fifth Aspect

In a display device according to a fifth aspect of the present disclosure, the control unit may calculate a corrected value by multiplying a value of drive current before correction by the weight coefficient and supply drive current having the calculated corrected value to the display panel.

With the above-described configuration, the value of current to be supplied to the display panel is corrected by uniformly multiplying the current value by the weight coefficient. Accordingly, a natural display screen that does not give a viewer a feeling of strangeness can be provided.

Sixth Aspect

In a display device according to a sixth aspect of the present disclosure, when the peripheral temperature is a prescribed temperature or higher, the control unit may calculate the corrected value and supply the drive current having the calculated corrected value to the display panel.

With the above-described configuration, when the temperature in the housing exceeds the prescribed value, the value of current to be supplied to the display panel is corrected by uniformly multiplying the current value by the weight coefficient. Accordingly, a natural display screen that does not give the viewer a feeling of strangeness can be provided.

Seventh Aspect

A display device according to a seventh aspect of the present disclosure may further include a main board that performs signal processing on video. The temperature sensor may be installed at a position corresponding to the main board.

With the above-described configuration, the temperature sensor of the temperature information acquisition unit is provided on the main board on which the control unit that controls the drive current value is mounted. Accordingly, the value of the drive current to be supplied to the display panel can be quickly corrected by using the acquired peripheral temperature.

Eighth Aspect

A display device according to an eighth aspect of the present disclosure may further include a power supply board; a source driver; and a controller board. The temperature information acquisition unit may include one temperature sensor or a plurality of temperature sensors. The one temperature sensor or the plurality of temperature sensors may be installed at a position or positions corresponding to at least one of the power supply board, the source driver, and the controller board.

With the above-described configuration, the peripheral temperature can be acquired at the position corresponding to at least one of the power supply board, the source driver, and the controller board that are components having relatively large amounts of heat generation among the components of the display panel. Accordingly, the drive current can be more appropriately controlled.

Ninth Aspect

In a display device according to a ninth aspect of the present disclosure, the temperature information acquisition unit may include at least one temperature sensor, and the at least one temperature sensor may be installed at a portion corresponding to the display panel.

With the above-described configuration, the peripheral temperature can be detected at the at least one portion in the housing of the display device. Accordingly, it is possible to more accurately detect the peripheral temperature and more accurately control the value of the drive current to be supplied to the display panel.

Tenth Aspect

In a display device according to a tenth aspect of the present disclosure, when a plurality of temperature sensors are disposed in a region defined by a target picture displayed by the display panel, the drive current in the region may be controlled by using a weight coefficient corresponding to a highest peripheral temperature among peripheral temperatures indicated by the plurality of temperature sensors.

With the above-described configuration, in the region defined by the target picture displayed by the display panel, the drive current value suitable for the region can be provided, and the viewer can view the display screen without unevenness in luminance in the region and without a feeling of strangeness.

Eleventh Aspect

In a display device according to an eleventh aspect of the present disclosure, the control unit may further control the drive current by using a weight coefficient corresponding to an average picture level value of the display panel.

With the above-described configuration, the value of the drive current can be appropriately controlled with regard to the average picture level value in addition to the surface temperature of the display panel. Accordingly, damage to the element can be more appropriately avoided.

Twelfth Aspect

In a display device according to a twelfth aspect of the present disclosure, as the average picture level value is larger, a weight coefficient closer to 1 may be used.

With the above-described configuration, since the load applied to the element is low when the average picture level value is large, it is possible to protect the element constituting the display panel while securing the luminance of the display screen by making the control on the drive current to be supplied to the display panel gentle.

Thirteenth Aspect

According to a thirteenth aspect of the present disclosure, there is provided a display control method of a display device, the display device including a display panel, a temperature information acquisition unit that acquires peripheral temperature information on a periphery of the display panel, and a control unit that controls drive current to be supplied to the display panel. The display control method includes acquiring the peripheral temperature information by the temperature information acquisition unit; and controlling, by the control unit, the drive current by using a weight coefficient corresponding to the peripheral temperature information acquired by the temperature information acquisition unit.

With the above-described configuration, an effect similar to that of the above-described display device can be obtained.

Fourteenth Aspect

According to a fourteenth aspect of the present disclosure, there is provided a non-transitory computer-readable recording medium storing a display control program for causing a computer to function as the above-described display device, the display control program causing the computer to function as the control unit.

With the above-described configuration, an effect similar to that of the above-described display device can be obtained.

Implementation Example by Software

A control block (particularly, the control unit 13) of the display device 1 (100, 200, 300) may be implemented by a logic circuit (hardware) formed in an integrated circuit (IC chip) or the like or may be implemented by software.

In the latter case, the display device 1 includes a computer that executes instructions of a program that is software that implements each function. The computer includes, for example, one or more processors and a computer-readable recording medium storing the program. In the computer, the processor reads the program from the recording medium and executes the program, thereby attaining the idea of the present disclosure. As the above-described processor, for example, a central processing unit (CPU) can be used. Examples of the recording medium include a "non-transitory tangible medium" such as a tape, a disk, a card, a semiconductor memory, and a programmable logic circuit, in addition to a read only memory (ROM). The computer may further include a random access memory (RAM) or the like for loading the program. The program may be supplied to the computer via any transmission medium (a communication network, a broadcast wave, or the like) capable of transmitting the program. An aspect of the present disclosure can be also implemented in a form of a data signal embedded in a carrier wave. In the form, the program is embodied through electronic transmission.

The present disclosure is not limited to the above-described embodiments, and various modifications are possible within the scope presented in the claims. Embodiments obtained by appropriately combining technical measures disclosed in different embodiments are also included in the technical scope of the present disclosure.

The present disclosure contains subject matter related to that disclosed in Japanese Priority Patent Application JP 2021-038666 filed in the Japan Patent Office on Mar. 10, 2021 and Japanese Priority Patent Application JP 2022-015062 filed in the Japan Patent Office on Feb. 2, 2022, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a display panel;

a temperature information acquisition unit that acquires peripheral temperature information on a periphery of the display panel; and a control unit that controls drive current to be supplied to the display panel at a first drive current value when a peripheral temperature indicated by the peripheral temperature information is within a prescribed temperature range, and at a second drive current value lower than the first drive current value when the peripheral temperature indicated by the peripheral temperature information is higher than the prescribed temperature range, wherein the control unit controls the drive current by using a weight coefficient that corresponds to the peripheral temperature information acquired by the temperature information acquisition unit and that is smaller than 1.

2. The display device according to claim 1, wherein the temperature information acquisition unit includes a temperature sensor disposed inside or outside the display panel.

3. The display device according to claim 1, wherein the display panel includes an organic electroluminescent (EL) element.

4. The display device according to claim 1, wherein the control unit further calculates a corrected value by multiplying a value of the drive current before correction by the weight coefficient and supplies the drive current having the calculated corrected value to the display panel.

5. The display device according to claim 4, wherein, when the peripheral temperature is a prescribed temperature or higher, the control unit calculates the corrected value and supplies the drive current having the calculated corrected value to the display panel.

6. The display device according to claim 2, further comprising:

a main board that performs signal processing on video, wherein the temperature sensor is installed at a position corresponding to the main board.

7. The display device according to claim 1, further comprising:

a power supply board;

a source driver; and a controller board, wherein the temperature information acquisition unit includes one temperature sensor or a plurality of temperature sensors, and wherein the one temperature sensor or the plurality of temperature sensors are installed at a position or positions corresponding to at least one of the power supply board, the source driver, and the controller board.

8. The display device according to claim 1, wherein the temperature information acquisition unit includes at least one temperature sensor, and wherein the at least one temperature sensor is installed at a portion corresponding to the display panel.

9. The display device according to claim 8, wherein, when a plurality of temperature sensors are disposed in a region defined by a target picture displayed by the display panel, the drive current in the region is controlled by using a weight coefficient corresponding to a highest peripheral temperature among peripheral temperatures indicated by the plurality of temperature sensors.

10. A display device comprising:

a display panel;

a temperature information acquisition unit that acquires peripheral temperature information on a periphery of the display panel; and a control unit that controls drive current to be supplied to the display panel at a first drive current value when a peripheral temperature indicated by the peripheral temperature information is within a prescribed temperature range, and at a second drive current value lower than the first drive current value when the peripheral temperature indicated by the peripheral temperature information is higher than the prescribed temperature range, wherein the control unit further controls the drive current by using a weight coefficient corresponding to an average picture level value of the display panel.

11. The display device according to claim 10, wherein, as the average picture level value is larger, a weight coefficient closer to 1 is used.

12. A display control method of a display device, the display device including a display panel, a temperature information acquisition unit that acquires peripheral temperature information on a periphery of the display panel, and a control unit that controls drive current to be supplied to the display panel, the method comprising:

acquiring the peripheral temperature information by the temperature information acquisition unit; and controlling, by the control unit, the drive current by using a weight coefficient corresponding to the peripheral temperature information acquired by the temperature information acquisition unit, wherein the control unit controls the drive current by using a weight coefficient that corresponds to the peripheral temperature information acquired by the temperature information acquisition unit and that is smaller than 1.

13. A non-transitory computer-readable recording medium storing a display control program, which when executed by at least one processor of a computer, causes the computer to function as the display device according to claim 1, the display control program further causing, when executed by the at least one processor, the computer to function as the control unit.

* * * * *